US005137002A

United States Patent [19]

Mahoney et al.

[11] Patent Number: 5,137,002

[45] Date of Patent: Aug. 11, 1992

[54] VAPOR SEPARATOR

[75] Inventors: J. Michael Mahoney, Bristol, Wis.; Eric D. Sandell, El Paso, Tex.

[73] Assignee: Outboard Marine Corporation, Waukegan, Ill.

[21] Appl. No.: 631,207

[22] Filed: Dec. 21, 1990

Related U.S. Application Data

[63] Continuation of Ser. No. 179,856, Apr. 11, 1988, abandoned.

[51] Int. Cl.[5] ..... F02M 39/00

[52] U.S. Cl. ..... 123/516; 123/179.9

[58] Field of Search ..... 123/516, 514, 510, 187.5

[56] References Cited

U.S. PATENT DOCUMENTS

| | | | |
|---|---|---|---|
| 1,119,980 | 12/1914 | Mulligan . | |
| 1,269,787 | 6/1918 | Church | 123/516 |
| 1,804,557 | 5/1931 | Gould et al. . | |
| 2,191,490 | 2/1940 | Mitterer | 123/516 |
| 2,281,283 | 4/1942 | Haast . | |
| 2,414,158 | 1/1947 | Mock | 123/516 |
| 2,742,049 | 4/1956 | Granberg | 137/202 |
| 2,745,511 | 5/1956 | Berck | 183/2.5 |
| 2,811,219 | 10/1957 | Wenzl | 183/2.5 |
| 2,878,889 | 3/1959 | Gilbert | 183/2.5 |
| 2,917,110 | 12/1959 | Brohl | 158/36 |
| 2,998,057 | 8/1961 | Graham | 158/36.3 |
| 3,031,010 | 4/1962 | Wise | 123/516 |
| 3,307,331 | 3/1967 | Lambert | 55/55 |
| 3,867,071 | 2/1975 | Hartley | 417/211.5 |
| 3,952,719 | 4/1976 | Fenton et al. . | |
| 3,961,918 | 6/1976 | Johnson | 55/170 |
| 3,985,626 | 10/1976 | Klein | 202/202 |
| 4,117,817 | 10/1978 | Nishida | 123/136 |
| 4,173,894 | 12/1979 | Nau . | |
| 4,543,938 | 10/1985 | Szlaga | 123/516 |

FOREIGN PATENT DOCUMENTS

| | | | |
|---|---|---|---|
| 3115504 | 2/1982 | Fed. Rep. of Germany . | |
| 856837 | 10/1940 | France . | |
| 2551134 | 3/1985 | France . | |
| 0027865 | 2/1983 | Japan | 123/516 |
| 1410374 | 10/1975 | United Kingdom . | |
| 2056569 | 3/1981 | United Kingdom | 123/516 |

*Primary Examiner*—Carl S. Miller

*Attorney, Agent, or Firm*—Michael, Best & Friedrich

[57] ABSTRACT

An engine assembly comprising an internal combustion engine, and a vapor separator including a fuel inlet adapted to communicate with a source of fuel, a fuel outlet communicating with the engine, a vapor outlet, and a valve mechanism operatively connected to the engine for opening the vapor outlet in response to operation of the engine and for closing the vapor outlet in response to non-operation of the engine.

21 Claims, 1 Drawing Sheet

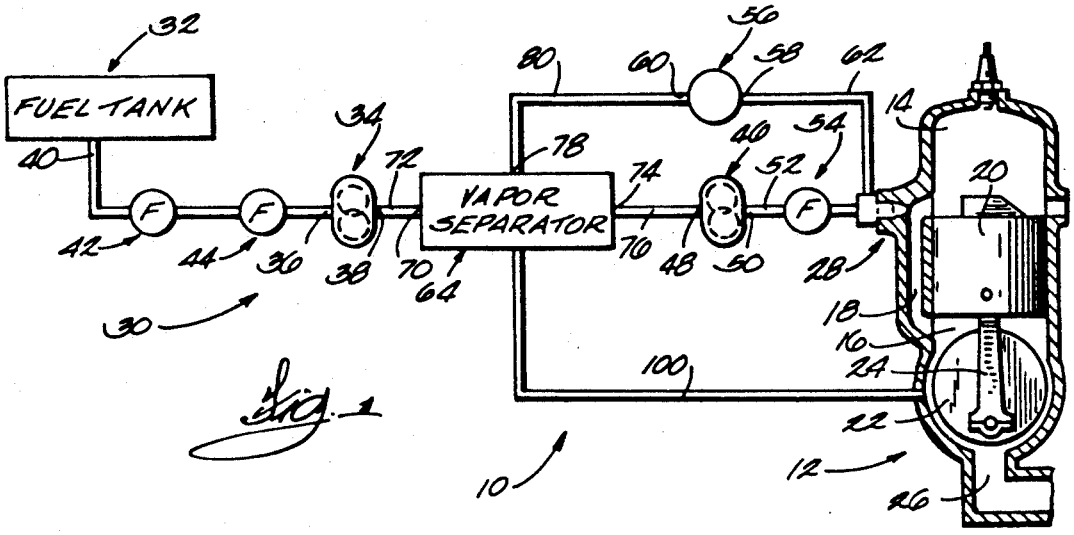
Fig. 1
Fig. 2.
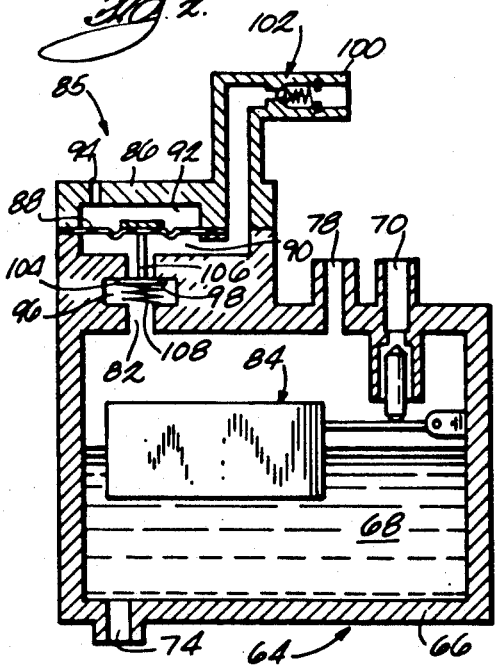
Fig. 3
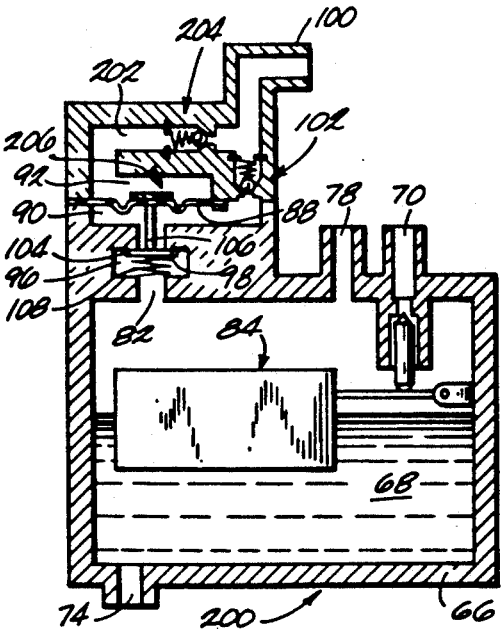

VAPOR SEPARATOR

This application is a continuation of Ser. No. 07/179,856, filed Apr. 11, 1988, now abandoned.

BACKGROUND OF THE INVENTION

The invention relates to vapor separators, and, more particularly, to vapor separators used in fuel feed systems for marine propulsion devices.

Known vapor separators used in fuel feed systems for outboard motors present at least two potential problems. First, liquid can flow through the vapor line when the outboard motor is tilted upwardly. Second, escaping vapor can fill the engine block and the motor cover when the engine is not running.

Attention is directed to the following U.S. Patents:

| | | |
|---|---|---|
| Gould et al. | 1,804,557 | May 12, 1931 |
| Mulligan | 1,119,980 | Dec. 8, 1914 |
| Granberg | 2,742,049 | Apr. 17, 1956 |
| Berck | 2,745,511 | May 15, 1956 |
| Wenzl | 2,811,219 | Oct. 29, 1957 |
| Gilbert | 2,878,889 | Mar. 24, 1959 |
| Brohl | 2,917,110 | Dec. 15, 1959 |
| Graham | 2,998,057 | Aug. 29, 1961 |
| Lambert | 3,307,331 | Mar. 7, 1967 |
| Hartley | 3,867,071 | Feb. 18, 1975 |
| Johnson | 3,961,918 | June 8, 1976 |
| Klein | 3,985,626 | Oct. 12, 1976 |
| Nishida | 4,117,817 | Oct. 3, 1978 |

Attention is also directed to U.S. Baltz pat. appl. Ser. No. 820,129, filed Jan. 21, 1986 and assigned to the assignee hereof.

SUMMARY OF THE INVENTION

The invention provides an engine assembly comprising an internal combustion engine, and a vapor separator including a fuel inlet adapted to communicate with a source of fuel, a fuel outlet communicating with the engine, a vapor outlet, and valve means operatively connected to the engine for opening the vapor outlet in response to operation of the engine and for closing the vapor outlet in response to non-operation of the engine.

In one embodiment, the engine includes a crankcase which creates a valve operating pressure, and the valve means opens the vapor outlet in response to creation in the crankcase of the valve operating pressure.

In one embodiment, the vapor outlet communicates with the crankcase.

In one embodiment, the valve means includes a housing, a movable diaphragm dividing the housing into first and second chambers, the first chamber communicating with the crankcase, and means for opening and closing the vapor outlet in response to movement of the diaphragm.

In one embodiment, the vapor outlet is opened in response to movement of the diaphragm in the direction decreasing the volume of the first chamber and is closed in response to movement of the diaphragm in the direction increasing the volume of the first chamber.

In one embodiment, the valve means also includes means for biasing the diaphragm in the direction increasing the volume of the first chamber.

In one embodiment, the second chamber communicates with the atmosphere.

In one embodiment, the crankcase creates alternating high and low pressures, and the valve means also includes means for permitting fluid flow from the first chamber to the crankcase and for preventing fluid flow from the crankcase to the first chamber, and means for permitting fluid flow from the crankcase to the second chamber and for preventing fluid flow from the second chamber to the crankcase.

The invention also provides an engine assembly comprising an internal combustion engine, a source of alternating high and low pressure, and a vapor separator including a fuel inlet adapted to communicate with a source of fuel, a fuel outlet communicating with the engine, a vapor outlet, and valve means for opening the vapor outlet in response to pressure from the source of pressure.

In one embodiment, the valve means opens the vapor outlet in response to engine operation.

In one embodiment, the engine includes a crankcase, and the source of pressure is the crankcase.

The invention also provides an engine assembly comprising an internal combustion engine including a crankcase which creates alternating high and low pressures, and a vapor separator including a fuel inlet adapted to communicate with a source of fuel, a fuel outlet communicating with the engine, a vapor outlet, a housing, a movable diaphragm dividing the housing into first and second chambers, first means for permitting fluid flow from the first chamber to the crankcase and for preventing fluid flow from the crankcase to the first chamber, and second means for selectively and alternatively permitting and preventing communication between the vapor outlet and the first chamber in response to movement of the diaphragm.

A principal feature of the invention is the provision of a vapor separator including a vapor outlet that is open when the engine is operating and is closed when the engine is not operating. This eliminates the possibility of undesired fluid flow through the vapor outlet when the engine is not operating.

Another principal feature of the invention is the provision of a crankcase-pulse-operated valve for opening and closing the vapor outlet.

Other features and advantages of the invention will become apparent to those skilled in the art upon review of the following detailed description, claims and drawings.

DESCRIPTION OF THE DRAWINGS

FIG. 1 is a schematic view of an engine assembly embodying the invention.

FIG. 2 is an elevational view of the vapor separator shown in FIG. 1.

FIG. 3 is an elevational view of a vapor separator that is an alternative embodiment of the invention.

DESCRIPTION OF THE PREFERRED EMBODIMENT

An engine assembly 10 embodying the invention is illustrated in FIG. 1. The engine assembly 10 comprises an internal combustion engine 12. In the preferred embodiment, the engine 12 is a two-cycle engine and is suitable for use in a marine propulsion device (not shown). The engine 12 includes a cylinder 14, a crankcase 16 which creates alternating high and low pressures, and a transfer passage 18 communicating between the crankcase 16 and the cylinder 14. The engine 12 also includes a Piston 20 slideably housed within the cylinder 14, a crankshaft 22 rotatably supported within the crankcase 16, and a connecting rod 24 connecting the crankshaft 22 to the piston 20. Air is drawn into the crankcase 16 through an air inlet 26, and fuel is injected into the cylinder 14 by a fuel injector 28.

The engine assembly 10 also comprises a fuel feed system 30. The fuel feed system 30 includes a fuel tank 32, a low-pressure fuel pump 34 having an inlet 36 and an outlet 38, and a fuel line 40 communicating between the fuel tank 32 and the inlet 36 of the pump 34. Preferably, the fuel line 40 has therein filters 42 and 44. The fuel feed system 30 also includes a high-pressure fuel pump 46 having an inlet 48 and an outlet 50, and a fuel line 52 communicating between the outlet 50 of the pump 46 and the fuel injector 28. Preferably, the fuel line 52 has therein a filter 54. The fuel feed system 30 also includes a pressure regulator 56 having an inlet 58 and an outlet 60, and a fuel return line 62 communicating between the fuel injector 28 and the pressure regulator inlet 58.

The fuel feed system 30 also includes a vapor separator 64 including a housing fuel 66 (FIG. 2) defining a fuel/vapor chamber 68 and having therein a fuel inlet 70 communicating with the pump outlet 38 via a fuel line 72, a fuel outlet 74 communicating with the pump inlet 48 via a fuel line 76, a fuel return inlet 78 communicating with the pressure regulator outlet 60 via a fuel return line 80, and a vapor outlet 82. The vapor separator 64 also includes a conventional float valve assembly 84 for opening and closing the fuel inlet 70 in response to variation of the fuel level within the fuel/vapor chamber 68.

The vapor separator 64 also includes valve means 85 operatively connected to the engine 12 for opening the vapor outlet 82 in response to operation of the engine 12 and for closing the vapor outlet 82 in response to non-operation of the engine 12. While various suitable valve means can be employed, in the preferred embodiment, the valve means 85 includes a fuel vapor outlet housing 86 integrally connected to the housing 66, and a flexible or movable diaphragm 88 dividing the housing into first and second or lower and upper chambers 90 and 92, respectively. The upper chamber 92 communicates with the atmosphere via an aperture 94 in the housing 86, and the lower chamber 90 communicates with the vapor outlet 82 via a passageway 96 having therein a valve seat 98.

The valve means 85 also includes means for permitting fluid flow from the lower chamber 90 to the crankcase 16 and for preventing fluid flow from the crankcase 16 to the lower chamber 90. While various suitable means can be used, in the illustrated construction, this means includes a vapor line 100 communicating between the lower chamber 90 and the crankcase 16 and having therein a check valve 102 (FIG. 2) which permits fluid flow only from the lower chamber 90 to the crankcase 16.

The valve means 85 also includes means for opening and closing the vapor outlet 82 in response to movement of the diaphragm 88. While various suitable means can be employed, in the preferred embodiment, this means includes means for selectively and alternatively permitting and preventing communication between the vapor outlet 82 and the lower chamber 90 in response to movement of the diaphragm 88. While various suitable means can be employed, in the illustrated construction, such means includes a valve member 104 movable into and out of engagement with the valve seat 98 for respectively closing and opening the passageway 96, and a rod 106 connecting the diaphragm 88 and the valve member 104 and causing common movement of the diaphragm 88 and the valve member 104. As shown in FIG. 1, the valve member 104 moves into engagement with the valve seat 98 in response to movement of the diaphragm 88 upwardly or in the direction increasing the volume of the lower chamber 90 and moves out of engagement with the valve seat 98 in response to movement of the diaphragm 88 downwardly or in the direction decreasing the volume of the lower chamber 90. Therefore, the vapor outlet 82 is closed in response to movement of the diaphragm 88 in the direction increasing the volume of the lower chamber 90 and is opened in response to movement of the diaphragm 88 in the direction decreasing the volume of the lower chamber 90.

The means for permitting and preventing communication between the vapor outlet 82 and the lower chamber 90 also includes means for biasing the valve member 104 into engagement with the valve seat 98 and thereby biasing the diaphragm 88 upwardly or in the direction increasing the volume of the lower chamber 90. While various suitable means can be employed, in the preferred embodiment, such means includes a spring 108 which biases the valve member 104 upwardly.

The vapor separator 64 operates as follows. When the engine 12 is operating, low pressure from the crankcase 16 establishes a relatively low pressure in the lower chamber 90. The pressure differential between the chambers 90 and 92 (the upper chamber 92 is at atmospheric pressure) creates a downward force on the diaphragm 88, which force overcomes the spring 108 and unseats the valve member 104 to establish communication between the vapor outlet 82 and the lower chamber 90. This allows vapor to be sucked from the fuel/vapor chamber 68 and through the vapor outlet 82, the lower chamber 90 and the vapor line 100 to the crankcase 16. Thus, the valve means 85 opens the vapor outlet 82 in response to pressure from a source of alternating high and low pressure. Preferably, the pressure source is the crankcase 16, and the vapor outlet 82 opens in response to creation of a valve operating pressure in the crankcase 16. It should be understood that in alternative embodiments the source of alternating pressure need not be the crankcase 16, but could be any suitable source.

When the engine 12 is shut off, the alternating pressure condition in the crankcase 16 changes to steady atmospheric or higher pressure, and the fuel/vapor chamber 68 changes to atmospheric or higher pressure. This creates a zero or upward force on the diaphragm 88. Therefore, the valve member 104 moves upwardly into engagement with the valve seat 98 and closes the vapor outlet 82.

An alternative embodiment of the invention is illustrated in FIG. 3. More particularly, an alternative vapor separator 200 is illustrated in FIG. 3. Except as explained hereinafter, the vapor separator 200 is substantially identical to the vapor separator 64 of the preferred embodiment, and common elements have been given the same reference numerals.

In the alternative embodiment, the upper chamber 92 is closed to the atmosphere, i.e., the aperture 94 is omitted, and the vapor separator 200 also includes means for permitting fluid flow from the crankcase 16 to the upper chamber 92 and for preventing fluid flow from the upper chamber 92 to the crankcase 16. While various suitable means can be employed, in the alternative embodiment, such means includes a passageway 202 having one end communicating with the upper chamber 92, and an opposite end communicating with the vapor line 100 between the check valve 102 and the crankcase 16. The passageway 202 has therein a check valve 204 that permits fluid flow from the crankcase 16 to the upper chamber 92 and prevents fluid flow from the upper chamber 92 to the crankcase 16. Furthermore, in the alternative embodiment, the diaphragm 88 has therein a bleed orifice 206, the reason for which is explained hereinafter.

The vapor separator 200 operates as follows. When the engine 12 is operating, low pressure from the crankcase 16 causes the lower chamber 90 to have a relatively low pressure, while high pressure from the crankcase 16 causes the upper chamber 92 to have a relative high pressure. The pressure differential between the chambers 90 and 92 causes the diaphragm 88 to move downwardly and open the vapor outlet 82. When the engine 12 is shut off, the pressures in the upper and lower chambers slowly equalize due to communication via the bleed orifice 206. Any net positive pressure in the chambers 90 and 92 relative to the pressure in the crankcase 16 is equalized through the check valve 102. Similarly, any net negative pressure in the chambers 90 and 92 relative to the pressure in the crankcase 16 is equalized through the check valve 204. Eventually, the pressures in the crankcase 16 and in the chambers 90 and 92 are equalized, the resultant force on the diaphragm 88 is zero, and the spring 108 moves the valve member 104 upwardly and closes the vapor outlet 82.

Various features of the invention are set forth in the following claims.

We claim:

1. An engine assembly comprising an internal combustion engine, said engine including a crankcase which creates a valve operating pressure, and a vapor separator including a fuel housing defining a chamber adapted to contain liquid fuel, a fuel inlet communicating with said chamber and adapted to communicate with a source of liquid fuel, a fuel outlet communicating with said chamber and with said engine for delivery thereto of liquid fuel, and a fuel vapor outlet communicating with said chamber and including valve means operatively connected to said engine for opening said fuel vapor outlet in response to operation of said engine and for closing said fuel vapor outlet in response to non-operation of said engine, said valve means opening said vapor outlet in response to creation in said crankcase of said valve operating pressure.

2. An engine assembly as set forth in claim 1 wherein said vapor outlet communicates with said crankcase.

3. An engine assembly as set forth in claim 1 wherein said valve means includes an outlet housing, a movable diaphragm dividing said outlet housing into first and second chambers, said first chamber communicating with said crankcase, and means for opening and closing said vapor outlet in response to movement of said diaphragm.

4. An engine assembly as set forth in claim 3 wherein said vapor outlet is opened in response to movement of said diaphragm in the direction decreasing the volume of said first chamber and is closed in response to movement of said diaphragm in the direction increasing the volume of said first chamber.

5. An engine assembly as set forth in claim 4 wherein said valve means also includes means for biasing said diaphragm in the direction increasing the volume of said first chamber.

6. An engine assembly as set forth in claim 3 wherein said second chamber communicates with the atmosphere.

7. An engine assembly as set forth in claim 3 wherein said crankcase creates alternating high and low pressures, and wherein said valve means also includes means for permitting fluid flow from said first chamber to said crankcase and for preventing fluid flow from said crankcase to said first chamber, and means for permitting fluid flow from said crankcase to said second chamber and for preventing fluid flow from said second chamber to said crankcase.

8. An engine assembly comprising an internal combustion engine, a source of alternating high and low pressure, and a vapor separator including a fuel housing defining a chamber adapted to contain liquid fuel, a fuel inlet communicating with said chamber and adapted to communicate with a source of liquid fuel, a fuel outlet communicating with said chamber and with said engine for delivery thereto of liquid fuel, and a fuel vapor outlet communicating with said chamber and including valve means for opening said fuel vapor outlet in response to pressure from said source of pressure.

9. An engine assembly as set forth in claim 8 wherein said valve means opens said vapor outlet in response to engine operation.

10. An engine assembly as set forth in claim 8 wherein said engine includes a crankcase, and wherein said source of pressure is said crankcase.

11. An engine assembly as set forth in claim 10 wherein said vapor outlet communicates with said crankcase.

12. An engine assembly as set forth in claim 8 wherein said valve means includes an outlet housing, a movable diaphragm dividing said outlet housing into opposite first and second chambers, said first chamber communicating with said source of pressure, and means for opening and closing said vapor outlet in response to movement of said diaphragm.

13. An engine assembly as set forth in claim 12 wherein said vapor outlet is opened in response to movement of said diaphragm in the direction decreasing the volume of said first chamber and is closed in response to movement of said diaphragm in the direction increasing the volume of said first chamber.

14. An engine assembly as set froth in claim 13 wherein said valve means also includes means for biasing said diaphragm in the direction increasing the volume of said first chamber.

15. An engine assembly as set forth in claim 12 wherein said second chamber communicates with the atmosphere.

16. An engine assembly as set forth in claim 12 wherein said valve means also includes means for permitting fluid flow from said first chamber to said pressure source and for preventing fluid flow from said pressure source to said first chamber, and means for permitting fluid flow from said pressure source to said second chamber and for preventing fluid flow from said second chamber to said pressure source.

17. An engine assembly comprising an internal combustion engine including a crankcase in which alternating high and low pressures are created and a vapor separator including a fuel housing defining a liquid fuel chamber adapted to contain liquid fuel, a fuel inlet communicating with said chamber and adapted to communicate with a source of liquid fuel, a fuel outlet communicating with said chamber and with said engine, and a vapor outlet communicating with said liquid fuel chamber, and including an outlet housing, a movable diaphragm dividing said outlet housing into first and second chambers, first means for permitting fluid flow from said first chamber to said crankcase and for preventing fluid flow from said crankcase to said first chamber, and second means for selectively and alternatively permitting and preventing communication between said liquid fuel chamber and said first chamber in response to movement of said diaphragm.

18. An engine assembly as set forth in claim 17 wherein said second means permits communication in response to movement of said diaphragm in the direction decreasing the volume of said first chamber and prevents communication in response to movement of said diaphragm in the direction increasing the volume of said first chamber.

19. An engine assembly as set forth in claim 18 wherein said valve means also includes means for biasing said diaphragm in the direction increasing the volume of said first chamber.

20. An engine assembly as set forth in claim 17 wherein said second chamber communicates with the atmosphere.

21. An engine assembly as set forth in claim 17 wherein said vapor separator further includes third means for permitting fluid flow from said crankcase to said second chamber and for preventing fluid flow from said second chamber to said crankcase.

* * * * *